United States Patent [19]

Hough et al.

[11] 4,114,784

[45] Sep. 19, 1978

[54] COMPARTMENTED COMPOSITE CONTAINER INCLUDING A SNAP-FIT SEPARATOR MEMBER

[75] Inventors: Robert J. Hough, Ballwin; John E. Bacon, St. Charles, both of Mo.

[73] Assignee: Boise Cascade Corporation, Boise, Id.

[21] Appl. No.: 783,788

[22] Filed: Apr. 1, 1977

[51] Int. Cl.[2] ..... B65D 25/04; B65D 85/36

[52] U.S. Cl. ..... 220/408; 206/216; 206/830; 220/307; 426/120; 426/128

[58] Field of Search ..... 426/120, 124, 128; 229/51 BP; 220/17, 307, 408; 206/216, 217, 830

[56] References Cited

U.S. PATENT DOCUMENTS

| | | | |
|---|---|---|---|
| 2,949,369 | 8/1960 | Zoeller et al. | 426/120 |
| 3,243,038 | 3/1966 | Caramanian | 220/17 |
| 3,293,433 | 12/1966 | Yokota et al. | 220/17 |
| 3,385,503 | 5/1968 | Stump | 426/120 |
| 3,420,397 | 1/1969 | Miller | 220/307 |
| 3,851,757 | 12/1974 | Turpin | 206/223 |
| 3,955,006 | 5/1976 | Sokolsky et al. | 426/124 |

FOREIGN PATENT DOCUMENTS

| | | | |
|---|---|---|---|
| 1,051,033 | 12/1966 | United Kingdom | 220/307 |

*Primary Examiner*—William Price
*Assistant Examiner*—Bruce H. Bernstein
*Attorney, Agent, or Firm*—Lawrence E. Laubscher

[57] ABSTRACT

A compartmented composite container package is disclosed including a tubular composite body wall member closed at one end by a metal closure member, the one end of said body wall member containing a cup for receiving a first product, characterized by the provision of a separator member that is connected with the open end of the cup by a snap-fit connection to isolate the first product from a second product that is introduced into the remaining space within the tubular wall member via the other end thereof. In order to further isolate the products from each other, the separator includes a radially enlarged cylindrical flange portion that circumferentially engages the uniform cylindrical inner wall surface of the tubular body wall member, thereby to cooperate with the snap-fit connection to provide a double sealing result.

3 Claims, 2 Drawing Figures

COMPARTMENTED COMPOSITE CONTAINER INCLUDING A SNAP-FIT SEPARATOR MEMBER

BRIEF DESCRIPTION OF THE PRIOR ART

Composite containers for packaging biscuit dough products and the like are well known in the patented prior art, as evidenced, for example, by the patents to Fienup et al U.S. Pat. Nos. 2,793,126 and 2,975,068, Geist et al U.S. Pat. No. 3,144,193, and Thornhill et al U.S. Pat. No. 3,981,433, among others. To open the Fienup et al and Geist et al composite containers, a label layer is removed, whereupon the container is struck against a sharp edge to effect bursting of the helical butt joint, and the ends of the container are then twisted in opposite directions to open the butt joint to a sufficient extent to permit the removal of the packaged biscuit dough sections or the like from the container. In the Thornhill et al patent, the composite container is so constructed that the helical butt joint automatically bursts open upon the removal of the outer label wrapper layer, so that it is unnecessary to strike the container against a sharp edge to open the same.

It is further known in the art to provide a compartmented composite container for packaging two associated products, such as biscuit or pastry dough on the one hand, and powdered or semifluid topping or frosting on the other hand. Examples of such compartmented containers are illustrated in the patents to Sarg U.S. Pat. No. 2,604,976, Zoeller et al U.S. Pat. No. 2,949,369 and Turpin U.S. Pat. Nos. 3,851,757 and 3,962,476. In these prior compartmented containers, it is conventional to separate the two packaged components by a divider or separator element that is snapped into a circumferential groove that is provided in the cylindrical inner wall surface of the tubular body wall member. This construction has several drawbacks. First, in the case of a container that requires striking against a sharp edge to effect bursting of the helical butt joint, the divider is often jarred loose during the opening operation, thereby resulting in undesirable spilling or leaking of the packaged topping product. Secondly, the container filling operation is rather complicated, since after the first product is introduced, it is difficult to insert the separator element with proper alignment and to snap it into the groove contained in the tubular body wall. Finally, in the case where a semi-liquid or liquid product is to be packaged, it has been necessary to bond the separator member to the open end of an inner cup member by means of a layer of sealant or adhesive, thereby complicating the container filling procedure by the step of applying the sealant layer to the separator member and/or to the open end of the cup member.

The present invention was developed to avoid the above and other drawbacks of the known compartmented composite containers.

SUMMARY OF THE INVENTION

In accordance with a primary object of the present invention, an improved compartmented composite container is disclosed including a separator member that is connected by means of a snap-fit connection with the open end of a cup-shaped member that is seated within the bottom portion of a composite container. In the preferred embodiment, the separator member is formed from sheet metal and includes a central disk portion that is inserted within the mouth of the cup-shaped member, and a cylindrical flange portion the external surface of which contains an annular groove for receiving in snap-fit relation an annular bead provided on the internal surface of the mouth portion of the cup-shaped member. Preferably, the cup-shaped member is formed from a high-density synthetic plastic material having sufficient resiliency to provide the desired snap-fit connection, whereby a fluid-tight seal between the separator member and the cup-shaped member is achieved.

In accordance with a more specific object of the invention, the cylindrical inner wall surface of the tubular body wall member is planar throughout its length, thereby to simplify the insertion of the cup-shaped member and the separator member into the container, said separator member including at the free end of the cylindrical flange portion a radially enlarged portion the external diameter of which corresponds generally with the internal diameter of the tubular body wall. Consequently, the outer circumference of the enlarged flange portion engages the inner wall surface of the tubular body wall to further seal and isolate the products from each other. If desired, a support disk may be seated upon the upper free end of the separator member to support the bottom surface of the second product packaged in the upper end of the container, the diameter of the support disk corresponding with the internal diameter of the tubular body wall.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
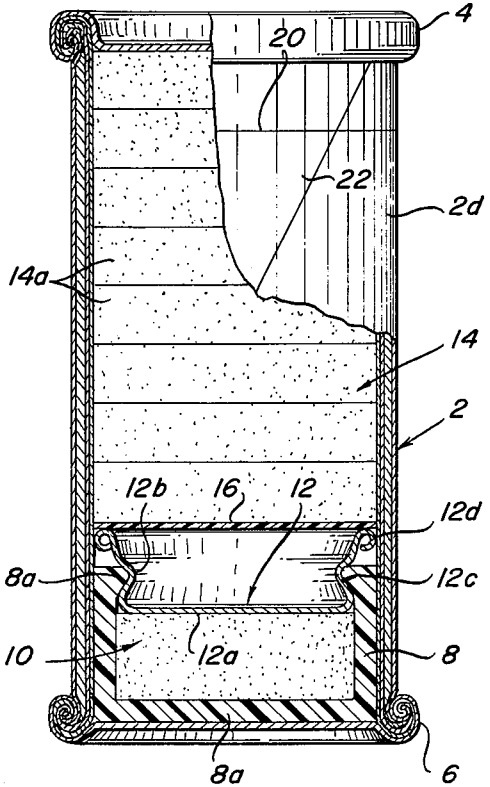
FIG. 1 is a partially sectioned side elevational view of the compartmented composite container of the present invention.

Referring now to the drawings, the compartmented composite container includes a tubular composite body wall 2 to the upper and lower ends of which are connected by a rolled seam connection a pair of middle end closure members 4 and 6, as is conventional in the art. Mounted in the bottom end of the tubular body wall 2 is a cup-shaped member 8 having a bottom wall portion 8*a* that is seated upon the bottom closure member 6. As shown in FIG. 1, the open top end of the cup-shaped member 8 faces the upper end of the container. Preferably the cup-shaped member 8 is formed of a suitable high-density synthetic plastic material, such as polypropylene, high-density polystyrene, or the like. The composite tubular body wall 2 includes, as is known in the art, an inner liner layer 2*a* of foil (for example aluminum foil) that may be coated with a protective layer of polyethylene 2*b*, a fibrous layer 2*c* (formed of paperboard, for example), and an outer label layer 2*d* of paper, foil or the like. The cup-shaped member 8 is adapted to receive a first product 10 which may be a powder, such as a frosting mix, or a semi-liquid product, such as a prepared frosting or icing, jelly, honey, butter, margarine, or the like.

Figure 2:
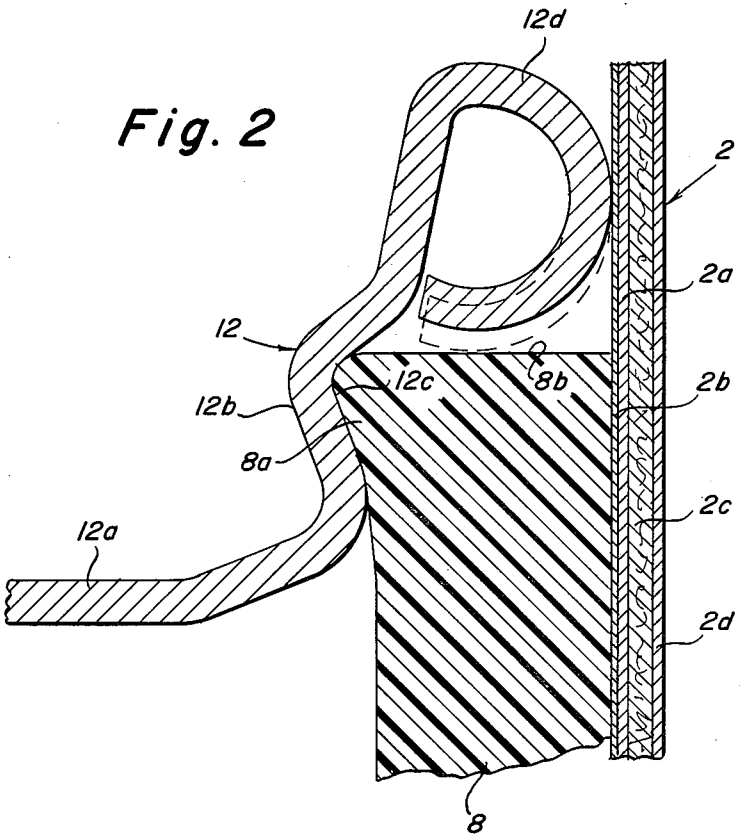
FIG. 2 is a detailed sectional view illustrating the snap-fit connection between the separator member and the cup-shaped member

In accordance with the present invention, a separator member 12 is provided for closing the upper open end of the cup member 8 to isolate the first product 10 from a second product 14 introduced into the remaining portion of the container. The second product, for example, may be a plurality of biscuit or pastry dough units 14*a*, as is known in the art. The separator member 12 is connected with the open mouth of the cup member by a snap-fit connection, thereby to seal the first product in the cup member. More particularly, the separator is formed from sheet metal and includes a central disk portion 12*a* that is arranged within the mouth of the cup member, and a cylindrical longitudinally extending neck portion 12*b* that is deformed to define in its external periphery a groove 12*c* that receives in snap-fit relation a corresponding resilient annular bead 8*a* formed on the internal surface of the mouth of the open top of the cup member 8. The free end of the neck portion 12*b* of the separator is reversely curled outwardly back upon itself to define a radially enlarged portion 12*d* the outer diameter of which corresponds with the inner diameter of the uniform planar cylindrical inner surface of the tubular body wall 2. Consequently the outer circumferential surface of the radially enlarged flange portion is in frictionally sealed engagement with the inner surface of the tubular wall member, thereby to further isolate the packaged products from each other. If desired, the reversely bent curled portion 12*d* may be so formed relative to the groove 12*c* as to engage the upper surface 8*b* of the cup 8, as shown in phantom in FIG. 2, thereby to further seal the products from each other.

To support the second product 14, a rigid support disk 16 of paperboard, metal, paper/foil laminate or the like is provided that is seated upon the upper surface of the separator 12, the diameter of the support disk corresponding with the internal diameter of the tubular body wall 2.

As is known in the art, the helically wound outer wrapper or label layer 2*d* may be provided with a circumferential collar cut 20 which defines a pull tab 22 for initiating manual removal of the outer wrapper when it is desired to open the container.

To assemble and fill the container, the cup member 8 is drawn by suction within the open-ended tubular body wall 2 to the position shown in FIG. 1, and the lower metal closure member 6 is connected with the bottom end of the tubular body wall. The first product 10 is then introduced into the cup member. In the event that this product is a dry powder or granular substance, it may be tamped into the cup if desired. The separator member 12 is then slid downwardly into the container and is connected with the mouth portion of the cup 8 by a snap-fit connection, the resilient annular bead 8*a* being received in sealed relation within the annular groove 12*c* contained in the flange portion 12*b* of the separator. The support disk 16 is then seated upon the upper surface of the separator 12, and the second product 14 is introduced into the container, whereupon the upper end of the tubular member 2 is closed by the upper end closure 4 to complete the package.

It will be apparent to those skilled in the art that various changes and modifications may be made in the described container. For example, it is within the scope of the present invention to form the annular groove of the snap-fit connection in the resilient inner wall surface of the mouth of the cup member, and to provide the projecting annular bead on the flange portion of the separator member. Other modifications may be made without deviating from the inventive concepts set forth above.

What is claimed is:

1. A compartmented composite container, comprising (a) a composite tubular body wall including a fibrous body wall layer and an impervious inner liner layer, the inner cylindrical circumferential surface of said body wall being uniform throughout its length;

(b) an end closure member connected to close one end of said body wall;

(c) a cylindrical open-ended synthetic plastic cup member arranged concentrically within said body wall with the bottom of said cup member seated on said end closure member, the outer diameter of said cup member corresponding generally with the inner diameter of said tubular body wall, thereby to permit said cup member to be slidably inserted within said tubular body wall, the open top end of said cup member including an upper end surface spaced from the other end of said tubular body wall;

(d) a rigid metal separator member closing the upper end of said cup member, whereby said cup member and the space between said separator member and the other end of said tubular body member are adapted to contain first and second products, respectively, separated by said separator member, said separator member including (1) a central circular disk-shaped portion arranged transversely within the open top end portion of said cup member, (2) a cylindrical neck portion which extends longitudinally upwardly through the open upper end of said cup member; and (3) a generally outwardly extending annular flange portion, (4) said flange portion terminating at its outer peripheral edge in a reversely curled portion; and (e) means defining a snap-fit connection between said separator neck portion and the upper end of said cup member, thereby to define a first pair of abutting sealing surfaces for separating the container products;

(f) the outer diameter of said separator flange portion corresponding with the inner diameter of the tubular body wall to effect frictional engagement between said flange portion and said body wall inner surface, thereby to define a second pair of abutting sealing surfaces for separating the container products;

(g) the reversely curled separator portion being in contiguous engagement with the upper end surface of said cup member, thereby to define a third pair of abutting sealing surfaces for separating the container products.

2. A compartmented container as defined in claim 1, wherein said snap-fit connection means comprises a radially-inwardly-extending annular bead on the inner surface of said cup member adjacent the upper end thereof, said bead extending within a corresponding annular groove contained in the outer surface of said separator neck portion.

3. A compartmented container as defined in claim 1, and further including a support disk seated on the upper surface of said separator flange portion, the diameter of said support disk corresponding generally with the internal diameter of the tubular body wall.

* * * * *